United States Patent [19]

Faunda

[11] Patent Number: 4,902,255

[45] Date of Patent: Feb. 20, 1990

[54] WEEDGUARD FOR ELECTRIC TROLLING MOTOR

[76] Inventor: Richard E. Faunda, P.O. Box 1858, Leesburg, Fla. 32749

[21] Appl. No.: 305,937

[22] Filed: Feb. 2, 1989

[51] Int. Cl.[4] ..... B63H 5/16

[52] U.S. Cl. ..... 440/71; 416/247 A

[58] Field of Search ..... 440/71, 72, 107; 416/247 A

[56] References Cited

U.S. PATENT DOCUMENTS

| | | | |
|---|---|---|---|
| 2,470,874 | 5/1949 | Sidney | 440/71 |
| 3,802,377 | 4/1974 | Porter et al. | 440/72 |
| 3,859,953 | 1/1975 | Todt | 440/72 |
| 3,965,845 | 6/1976 | Lubov | 440/71 |
| 4,565,533 | 1/1986 | Springer | 440/71 |
| 4,718,871 | 1/1988 | Mendel | 440/71 |

*Primary Examiner*—Sherman D. Basinger
*Assistant Examiner*—Stephen P. Avila
*Attorney, Agent, or Firm*—Harold H. Dutton, Jr.

[57] ABSTRACT

A weedguard for attachment to electric trolling motors having a motor housing and a motor support shaft, the weedguard comprising a lower triangular frame member portion and an upper arm portion, the triangular frame portion having a flange for attachment to the motor housing so that the triangular frame portion has one apex toward the front of the motor housing and extends downwardly and rearwardly from the apex with respect to the motor housing; the upper arm portion being secured to the triangular frame portion at that apex and extending upwardly and forwardly therefrom, and a rearward extension member extending from the upper arm portion toward the motor shaft for attachment to the motor shaft.

8 Claims, 1 Drawing Sheet

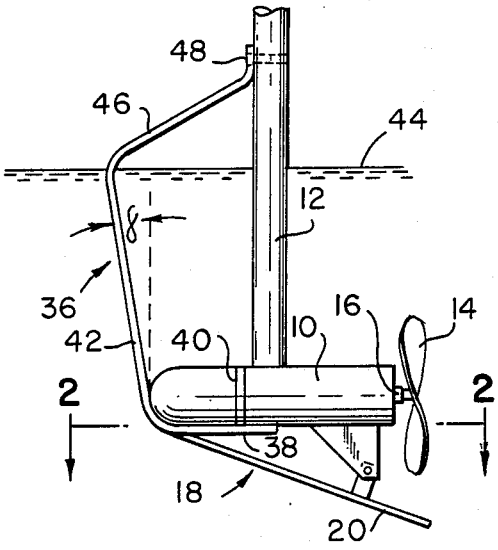
Fig. 1
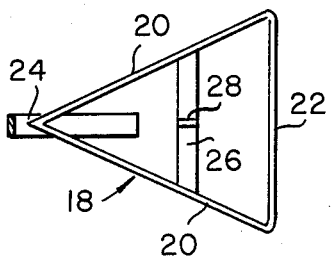
Fig. 2
Fig. 3
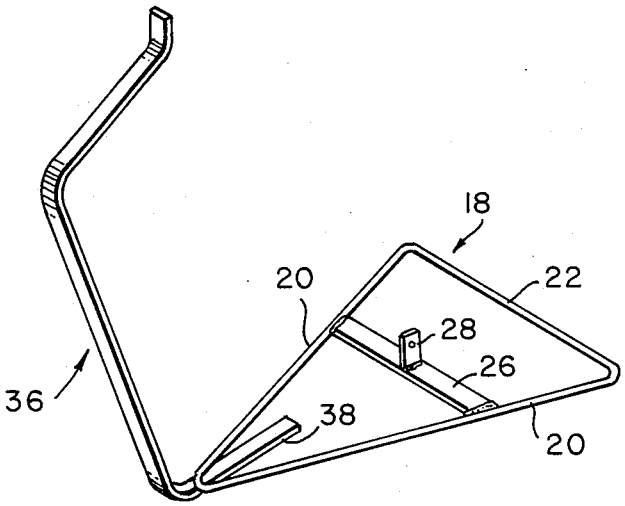

WEEDGUARD FOR ELECTRIC TROLLING MOTOR

This invention relates to a weedguard for electric trolling motors of the kind used on fishing boats. More particularly, the invention relates to a weedguard of novel and simple, yet reliable construction.

BACKGROUND AND OBJECTS OF THE INVENTION

In recent years, sport fishing has grown immensely in sophistication and popularity. The pursuit of gamefish has become a profession to many and an extensive hobby with a large portion of the populace. The techniques used among such fishermen have become quite sophisticated and serious, and anglers have become quite knowledgeable about their sport.

One well accepted fact is that fish tend to concentrate around "cover" in the water, and often the thicker the cover, the more and larger are the fish. "Cover" is considered to be any of a variety of things, either natural or manmade, in the water which serve to hide or protect the fish in their aquatic environs. One of the thickest forms of "cover" and particularly in more southern parts of the country is grass. Many species of grass exist in natural and manmade lakes, and the grass in many cases can become so thick as to make navigation difficult or impossible.

Yet, grass is such an excellent cover for fish that anglers often seek to enter even the thickest grassbeds in pursuit of fish.

One common accessory on most fishing boats is a small, electric motor which is used to maneuver the boat during the fishing. Such motors are quiet and efficient, typically operated by batteries in the boat, and are far more effective during fishing than the larger and powerful combustion engines which are usually used for travel over greater distances. Such electric motors are often mounted on the bow of the boat, and steered either by hand or by foot. Indeed, such motors may be used by the fisherman without stopping his fishing or without taking his line out of the water. These motors are commonly referred to as "trolling" motors to distinguish them from the combustion engines which are the primary power for the boat.

Indeed, such electric motors are frequently the only type of motors permitted on numerous small fishing lakes, as these motors permit the boat to travel around the lake, but with almost no wake or noise.

One of the disadvantages of these motors, however, is the fact that the propellers can be quickly tangled with grass to the point where the motor does not have enough power to turn. This is a particularly problem in southern lakes where grass grows more thickly all year. In order for the motor to operate efficiently, it must have a continuous flow of water, but the grass blocks this flow, thereby preventing the motor from functioning properly or efficiently.

In the past, a variety of techniques have been developed for overcoming this problem. One of the earliest devices was simply a conical basket which is attached to the motor. The basket is secured around the motor housing with its axis concentric with the motor shaft axis The perforate nature of the basket would allow the flow of water, while the perforations would allow the water to flow through to the propeller.

However, such baskets tended to catch and hold the grass which they encountered, and periodically the motor and basket would have to be removed from the water and the grass manually removed from the basket. The grass would become so thick on the basket that a considerable drag was generated slowing or even stopping the boat. Thus, even though the grass did not come in contact with the propeller, it nonetheless did prevent the proper functioning of the motor.

A more recent advance has been the development of "weedless" propellers. Such propellers tend to shed the grass or weeds from the blades of the propeller, and are remarkably efficient. While these propellers are quite effective, they are not available for all motors, and many motors are in use without such newer propellers.

Thus, a need still exists for improved weedguards for electric trolling motors.

Accordingly, primary object of this invention is to provide an improved weedguard for electric trolling motors.

Still another object of this invention is to provide a weedguard of simple, yet effective construction.

A further object of this invention is to provide a weedguard which may be attached to any type of trolling motor.

Yet another object of the invention is to provide a weedguard which is more effective and reliable than the prior art weedguards.

Still a further object of the invention is to provide a weedguard which sheds grass and weeds away from the motor structure so as to avoid interference with the propeller.

DESCRIPTION OF THE DRAWINGS

These and other objects of the invention will become apparent from a detailed consideration of the description which follows, when taken together with the accompanying drawings, in which:

FIG. 1 is a side elevation of a trolling motor with a weedguard according to this invention;

FIG. 2 is a sectional view along lines 2–2 of FIG. 1 and viewed in the direction of the arrows; and FIG. 3 is a perspective view of a weedguard according to this invention.

DESCRIPTION OF THE INVENTION

The weedguard according to the invention comprises an essentially triangular frame member mounted in such a way as to lie beneath the motor and propeller. One apex of the frame is positioned near the leading end of the motor housing and a side of the frame opposite that apex is positioned beneath the propeller at the trailing end of the motor. The frame is secured to the motor, as by means of a cross member secured to the skeg of the motor.

At the front of the motor, a bracket extends upwardly at a forward angle from the apex of the triangular frame to which it is secured, in front of and at a forward angle to the motor support shaft. This bracket extends upwardly well above the motor housing to a point near the waterline or even above. An upper extension of the bracket is secured to the motor support shaft above the motor housing.

The upwardly extending bracket is positioned at a forward angle with respect to the vertical (and the motor support shaft) of at least about 10°, and preferably about 20°–30°. While the angle may be greater, this will not significantly enhance the weed shedding ability of the weedguard, but will increase the overall size of the weedguard, to the point where it will take up more space when the motor is stored out of the water, as for example when travelling under power of the combustion engine.

A rearward extension of the front bracket extends beneath the motor housing toward the rear, and may be secured about the motor housing, for example with a clamp.

The upwardly extending bracket, because of its angle with the vertical motor shaft, tends to shed the grass and weeds downwardly, and the downwardly angled triangular frame also tends to shed the grass and weeds downwardly and back below and behind the propeller. Thus, weeds are kept away from the propeller, and the motor can continue to operate freely in water infested with grass and weeds.

The device also is of adequate strength to protect the propeller from accidental contact with underwater obstructions such as rocks or stumps which would otherwise damage the propeller.

DESCRIPTION OF THE PREFERRED EMBODIMENTS

The invention will now be described in greater detail with reference to the accompanying drawings which show one embodiment of the invention.

FIG. 1 of the drawings shows the lower portion of a typical trolling motor which includes a support shaft 10, and the motor housing 12 at the lower end of the shaft 10. A propeller 14 is secured to the armature shaft 16 of the motor. The motor is supported from the boat by the shaft, and steering of the motor is accomplished by rotating the shaft 12 and the motor 10 about the axis of the shaft 12, so as to change the direction of thrust of the propeller 14. The arrangement by which the motor and shaft are supported from the boat and steered form no part of this invention, and are therefor not described in greater detail.

The weedguard of the invention is seen to include a lower triangular frame member, generally designated 18, formed of two side arms 20 and a connecting arm 22. The side arms 20 are joined at an apex 24. Thus, the frame member may be made into a triangular shape from a single piece of material, or may be formed of three attached arms. A cross member 26 joins the side arms 20 and includes an upstanding flange 28 near the midpoint thereof. This flange may be secured to the skeg 30 on the motors 10 by a bolt (not shown).

As is shown in FIG. 1, the plane of the triangular frame member 18 is downwardly and rearwardly inclined with respect to the horizontal axis of the motor housing 10 and propeller shaft 16.

At the leading, upper apex 24 of the frame member 18, a front bracket generally designated 36 is secured to the frame member 18. This bracket 36 includes an arm 38 at the lower end which is positioned beneath the motor housing 10, and which may be secured about the housing 10 by a circular clamp 40.

An upwardly extending portion 42 extends from the arm 38 in front of the motor shaft 12 to a point near or slightly above the water line 44. This portion 42 is positioned at an angle $\alpha$ with respect to the (vertical) motor support shaft 12 as seen in FIG. 1. This angle should be at least 10°, and preferably about 20-30°with respect to the vertical.

A rearward portion 46 of the bracket 36 extends upwardly and rearwardly toward the motor shaft, terminating in a short vertical flange 48. This flange 48 may be secured to the motor shaft 12 by a screw or by another circular clamp.

This arrangement provides a secure attachment to the trolling motor: to the skeg, the motor housing, and to the shaft. Since the motor and shaft rotate during steering of the trolling motor, such a strong attachment is important for reliability of the weedguard, particularly when striking an underwater object.

The portion 42 of the front bracket, being angled downwardly and rearwardly from a point above the water line, and causes any grass or weeds to slide downwardly as the motor progresses through the water. Upon reaching the bottom of the bracket 42, the downward and rearward movement of the grass is caused to continue, due to the triangular frame portion 18. Further, this frame portion also keeps the grass away from the propeller until after the motor has passed.

While this invention has been described as having certain preferred features and embodiments, it will be understood that it is capable of still further variation and modification without departing from the spirit of the invention, and this application is intended to cover any and all variations, modifications and adaptations of the invention which fall within the spirit of the invention and the scope of the appended claims.

I claim:

1. A weedguard for attachment to electric trolling motors having a motor housing and a motor support shaft and comprising a lower triangular frame member portion and an upper arm portion, said triangular frame portion having means for attachment to said motor housing so that said triangular frame portion has one apex toward the front of said motor housing and extends downwardly and rearwardly from said apex with respect to said motor housing; said upper arm portion being secured to said triangular frame portion at said apex and extending upwardly and forwardly therefrom, a rearward extension member extending from said upper arm portion toward said motor shaft for attachment to said motor shaft, said upper arm portion including a lower rearward extension for extending along and beneath said motor housing, and said triangular frame portion including a cross member extending between two sides thereof and a flange member upstanding from said cross member for attachment to a skeg on said motor housing.

2. A weedguard as in claim 1 and wherein said upper arm portion extends upwardly at an angle of at least about 10 degrees to the motor shaft.

3. A weedguard as in claim 2 and wherein said upper arm portion extends upwardly at an angle of about 20°-30° to the motor shaft.

4. An electric trolling motor having a motor housing, a skeg extending downwardly from said motor housing, and a shaft for supporting said motor housing, a weedguard secured to said trolling motor and comprising a lower triangular frame member portion and an upper arm portion, said triangular frame portion having means for attachment to said skeg so that said triangular frame portion has one apex mounted at the front of said motor housing and extends downwardly and rearwardly from said apex with respect to said motor housing; said upper arm portion being secured to said triangular frame portion at said apex and extending upwardly and forwardly therefrom, a rearward extension member extending from said upper arm, portion toward said motor shaft for attachment to said motor shaft, said arm portion including a lower extension beneath said motor housing and means securing said lower extension to said motor housing.

5. An electric trolling motor as in claim 4 and wherein said securing means comprises a circular clamp surrounding said motor housing and said lower extension.

6. An electric trolling motor as in claim 4 and wherein said triangular frame member portion includes a cross member extending between two sides of said frame member portion, an upstanding flange near the midpoint of said cross member, and means for securing said flange to said skeg.

7. An electric trolling motor as in claim 6 and including means for securing said rearward extension member to said shaft.

8. An electric trolling motor as in claim 7 and wherein said upper arm portion is positioned at an angle of at least about 10° to said motor shaft.

* * * * *